US012258842B1

(12) United States Patent
Riggins

(10) Patent No.: US 12,258,842 B1
(45) Date of Patent: Mar. 25, 2025

(54) DOWNHOLE WASH TOOL WITH A SPEED LIMITING BRAKE

(71) Applicant: Halliburton Energy Services, Inc., Houston, TX (US)

(72) Inventor: Carson Edward Riggins, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/545,684

(22) Filed: Dec. 19, 2023

(51) Int. Cl.
*E21B 37/06* (2006.01)

(52) U.S. Cl.
CPC ..... *E21B 37/06* (2013.01)

(58) Field of Classification Search
CPC ..... E21B 37/06; E21B 43/34; C09K 8/34
USPC ..... 166/312
See application file for complete search history.

(56) References Cited

U.S. PATENT DOCUMENTS

| | | | | |
|---|---|---|---|---|
| 5,518,379 | A | 5/1996 | Harris et al. | |
| 5,785,509 | A | 7/1998 | Harris et al. | |
| 5,833,444 | A | 11/1998 | Harris et al. | |
| 6,335,502 | B1 | 1/2002 | Surjaatmadja et al. | |
| 7,396,220 | B2 | 7/2008 | Delpassand et al. | |
| 8,931,558 | B1 * | 1/2015 | Harper | E21B 37/00 134/167 C |
| 9,309,767 | B2 | 4/2016 | Sreshta et al. | |
| 9,482,223 | B2 | 11/2016 | Jarvis et al. | |
| 9,540,933 | B2 | 1/2017 | Morris | |
| 10,010,894 | B2 * | 7/2018 | Andersen | F16D 57/007 |
| 10,118,185 | B2 | 11/2018 | Scheider | |
| 11,795,761 | B2 | 10/2023 | Riggins et al. | |
| 2004/0016540 | A1 | 1/2004 | Jarchau et al. | |
| 2009/0152009 | A1 * | 6/2009 | Slay | C08K 5/549 418/61.3 |
| 2010/0038142 | A1 | 2/2010 | Snyder | |
| 2011/0116960 | A1 | 5/2011 | Akbari et al. | |
| 2012/0168228 | A1 | 7/2012 | Giroux et al. | |
| 2012/0201659 | A1 | 8/2012 | Savage et al. | |
| 2015/0308232 | A1 * | 10/2015 | Hallundbaek | E21B 23/03 166/185 |
| 2017/0037685 | A1 | 2/2017 | Strachan | |

(Continued)

FOREIGN PATENT DOCUMENTS

| | | |
|---|---|---|
| CN | 202108436 | 1/2012 |
| CN | 104563858 | 4/2015 |

(Continued)

OTHER PUBLICATIONS

"Search Report and Written Opinion issued for PCT Application pct/us2022012664", Oct. 7, 2022, 8 pages.

(Continued)

*Primary Examiner* — William D Hutton, Jr.
*Assistant Examiner* — Ashish K Varma
(74) *Attorney, Agent, or Firm* — DeLizio, Peacock, Lewin & Guerra, LLP

(57) ABSTRACT

Some implementations include an apparatus for washing a downhole tubular. The apparatus may include a head coupled to a rotatable shaft, the head including one or more jets configured to emit fluid to cause the head to rotate on the rotatable shaft and wash the downhole tubular. The apparatus may include one or more brakes coupled with the rotatable shaft and configured to control rotation of the head.

20 Claims, 6 Drawing Sheets

(56) References Cited

U.S. PATENT DOCUMENTS

| | | | |
|---|---|---|---|
| 2017/0122034 | A1 | 5/2017 | Nichols et al. |
| 2019/0330925 | A1 | 10/2019 | Marchand et al. |
| 2019/0345769 | A1 | 11/2019 | Schultz et al. |
| 2023/0228152 | A1 | 7/2023 | Riggins |

FOREIGN PATENT DOCUMENTS

| | | |
|---|---|---|
| CN | 213419075 | 6/2021 |
| CN | 113090207 | 7/2021 |
| CN | 216277747 | 4/2022 |
| CN | 116025551 | 4/2023 |

OTHER PUBLICATIONS

"U.S. Appl. No. 17/576,327 Office Action", Mar. 1, 2023, 13 pages.
"PCT Application No. PCT/US2023/084978 International Search Report and Written Opinion", Sep. 6, 2024, 16 pages.

* cited by examiner

DOWNHOLE WASH TOOL WITH A SPEED LIMITING BRAKE

TECHNICAL FIELD

The disclosure generally relates to the field of subsurface operations and, more specifically, to a tool for washing materials from downhole tubulars.

BACKGROUND

In downhole environments (such as hydrocarbon production environments), various tubing may become blocked with scale or other materials. Some tools for removing the scale from inside the tubing may include positive displacement motors, gearing, and other complex components. Some tools may rotate inside the tubing and use viscous fluids to inhibit rotation of the tools.

BRIEF DESCRIPTION OF THE DRAWINGS

Aspects of the disclosure may be better understood by referencing the accompanying drawings.

DESCRIPTION

The description that follows includes example systems, methods, techniques, and operational flows that embody aspects of the disclosure. However, this disclosure may be practiced without these specific details. For clarity, some well-known structures and techniques have been omitted.

In downhole environments (such as hydrocarbon production environments), tubing may become occluded with scale or other materials. Some implementations include a downhole tool configured to wash scale and/or other materials from inside tubing. The tool may include a cleaning head that spins and sprays water or other fluids onto the scale, thereby removing the scale from inside the tubing. Pressurized fluid may cause the cleaning head to spin. Hence, the tool need not include a positive displacement motor nor reduction gearing. The tool also may include brakes that control the spin rate of the cleaning head. Hence, the tool does not need viscous fluids to slow the spin rate of the cleaning head. In some implementations, the brakes may increase frictional forces as the spin rate of the cleaning head increases. Thus, the brakes may be configured to maintain specific rotation speeds (or ranges of rotation speeds) that optimize cleaning of the tubing.

Figure 1:
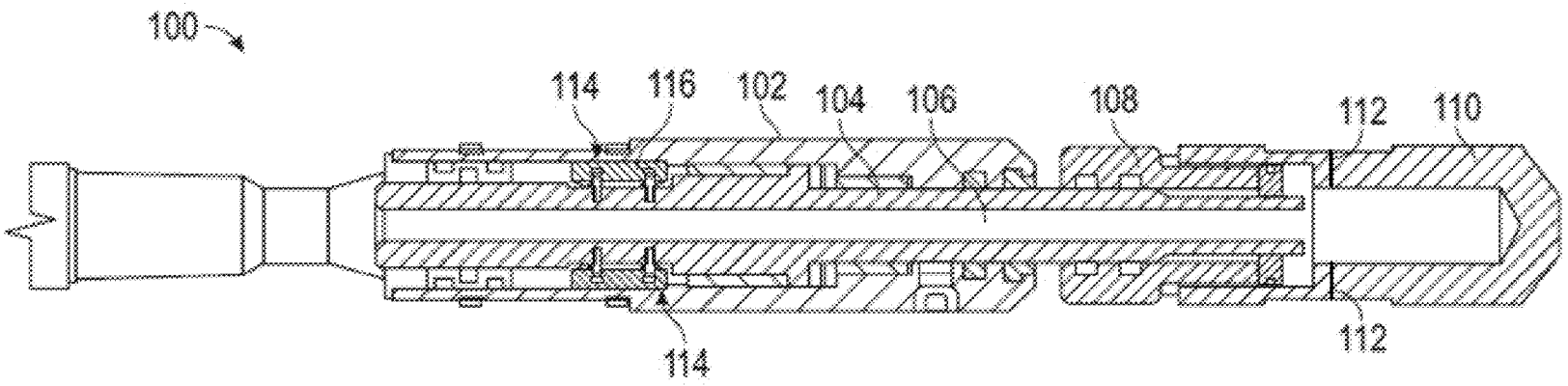
FIG. 1 is a cross-sectional view of a downhole tool for washing tubing.

FIG. 1 is a cross-sectional view of a downhole tool for washing tubing. In FIG. 1, the tool (also referred to herein as a washing tool) 100 may be configured for insertion into downhole tubulars and for washing scale and other materials built-up inside the tubulars. The tool 100 may include a housing 102 that contains a rotatable shaft 104. The shaft

104 may extend through the housing 102. The portion of the shaft 104 extending through the housing 102 may be connected to a coupler 108 that rotates with the shaft 104. The coupler 108 may be configured to connect to a head 110 (also referred to herein as a cleaning head).

The head 110 may include jets 112 configured to spray pressurized fluid or other pressurized fluid to produce thrust that spins the head 110 on the shaft 104. The pressurized fluid may travel through the cavity 106 into the jets 112 that are disposed in the head 110. The jets 112 may be positioned at any suitable angle relative to the shaft 104 and/or relative to the outer surface of the head 110, such as at any angle that may cause the pressurized fluid to spray eccentrically relative to the outer surface of the head 110. By eccentrically spraying fluid, the jets may project a water stream that causes the head 110 to spin. One or more of the jets 112 may be positioned to direct the pressurized fluid radially outward to wash a downhole tubular. The jets 112 may vary in shape, size, flow rate, and orientation based on various factors such as tool size, materials to be washed, pressure of the fluid (such as water) used to spin the tool, and other factors. The jets may be implemented by removing material from the head 110 to form passage ways through which the high pressure water flows, by including sockets into which jets are fastened (such as by threading, pressing, etc.), or by any other suitable manner. In some implementations, jet flow rate, jet orientation, fluid pressure, and other factors may be selected to achieve desired spin-rate behavior of the head 110 and shaft 104. For example, a particular jet flow rate, jet orientation, and fluid pressure may cause the head 110 to spin at 500 revolutions per minute. After selecting the aspects of the head 110, spin rate may be predictably changed by increasing or decreasing fluid pressure. Spin rates may be selected based on effectiveness for particular washing applications.

The tool 100 also may include one or more brakes 114 that slow, stop, or otherwise control the rate at which the shaft 104 and the head 110 spin. The brakes 114 may be coupled to the shaft 104 and may spin when pressurized water causes the shaft 104 to spin (see discussion of jets 112). The brakes 114 may include pads 116 that apply frictional forces to the housing 102. As the shaft 104 and brakes 114 spin, centrifugal forces may move the pads 116 in contact with the housing 102. The pads 116 may apply more frictional forces as the shaft 104 spins faster. For example, the frictional forces may increase as centrifugal forces increase when the shaft 104 spins faster.

Figure 2:
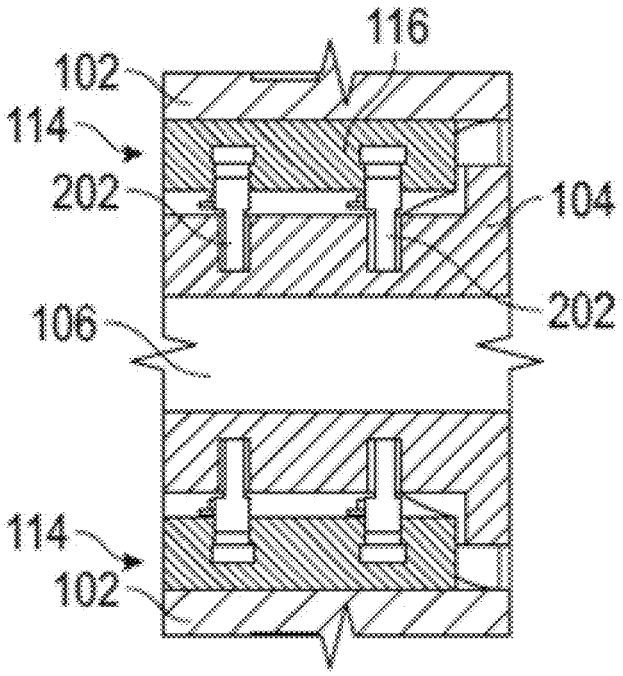
FIG. 2 is a cross-sectional close-up view of the brakes mounted to the shaft.

FIG. 2 is a cross-sectional view of the brakes mounted to the shaft. In FIG. 2, each brake 114 may include fasteners 202 and a pad 116. Each pad 116 may be connected to the shaft 104 by the fasteners 202. The pads 116 may include elastomeric material or any other material (such as metal, plastic, organic materials, etc.) suitable to create a frictional force when in contact with the housing 102. The pads 116 can be adjusted to apply particular frictional forces such as by changing materials, size, orientation, and other aspects of the pads 116. For example, for a desired spin rate (such as 500 RPMs) for a given shaft weight, shaft speed, and frictional force needed to maintain the desired spin rate, a particular combination of pad size, pad material, and spring tension may be selected for the brakes 114.

In some implementations, the fasteners 202 are threaded pins configured to thread into the shaft 104 and hold the pads 116 within a range of motion. Each fastener 202 may cooperate with a spring (not shown in FIG. 2) configured to apply radial force sufficient to keep the pads 116 in contact with the housing 102 while the shaft 104 is at rest and while the shaft 104 is spinning (springs shown in FIGS. 3 and 4A). Hence, the springs may hold the pads 116 in contact with the housing 102 to create an initial frictional force to control an initial spin rate of the shaft 104. As the spin rate of the shaft 104 increases, centrifugal force may push the pads 116 into housing 102 with greater force. As the spin rate of the shaft 104 decreases, there may be less centrifugal force and therefore less frictional force. Hence, in some implementations, the brakes 114 may automatically apply more or less frictional force (to control spin rate) as the shaft 104 spins at different rates.

The brakes 114 may be configured to control the spin rate of the head 110 within a particular range based on fluid pressure, properties of the jets 112, and other factors that may affect the spin rate (such as in revolutions per minute (RPM)). For example, the brakes 114 may be configured to maintain a spin rate of 500 RPMs while the tool 100 is receiving fluid at a given pressure. As the fluid pressure or other factors change, the brakes 114 may be adjusted to maintain a spin rate that results in effective washing of the tubular. For example, adjustments may be made to the spring tension, pad materials, and other aspects of the brakes 114.

Figure 3:
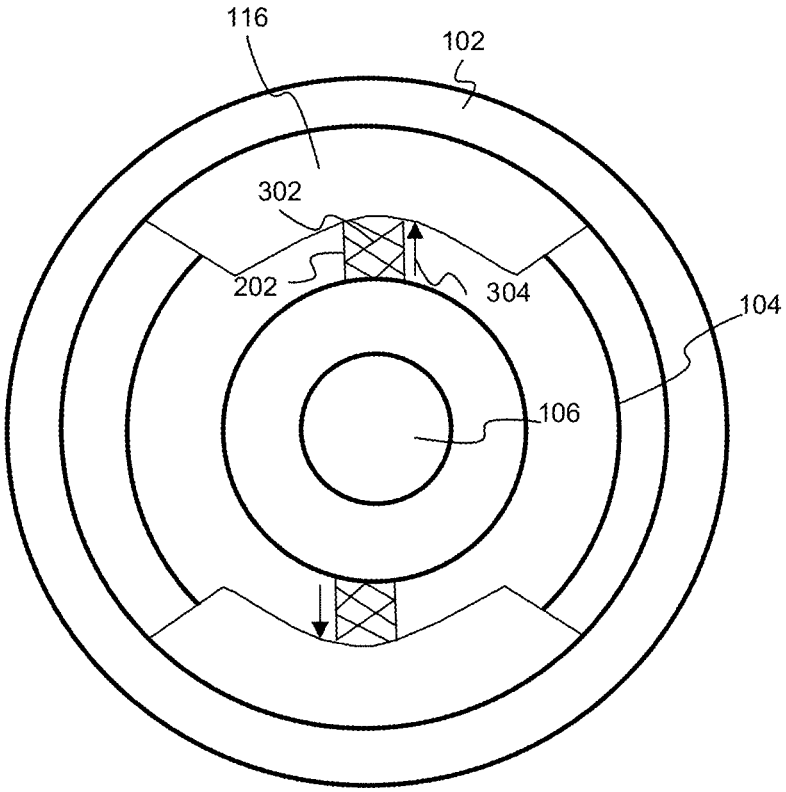
FIG. 3 is a cross-sectional view of the brakes of the tool.

FIG. 3 is a cross-sectional view of the brakes of the tool. In FIG. 3, a spring 302 may surround each fastener 202. As noted, the springs 302 may apply force 304 sufficient to hold the pads 116 in contact with the housing 102.

Figure 4A:
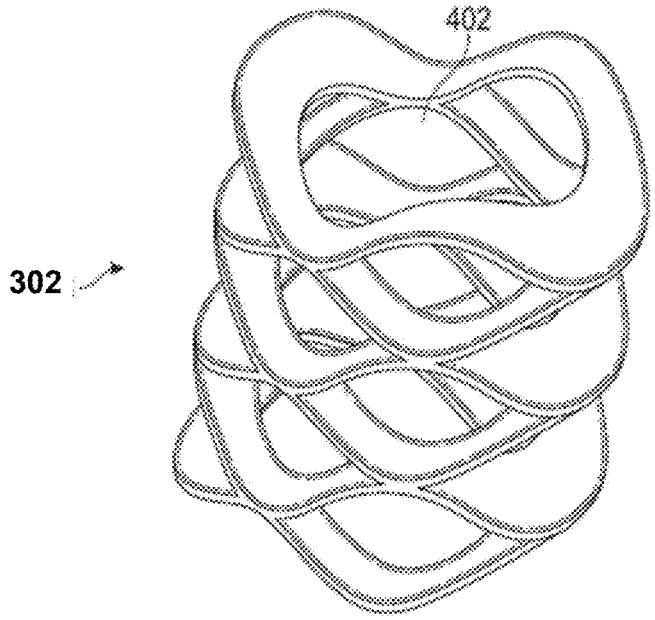
FIG. 4A is a perspective view of a spring that may be included in a brake of the tool.

FIG. 4A is a perspective view of a spring that may be included in a brake of the tool. In FIG. 4A, the spring 302 is a wave spring. The wave spring may include a center space 402. In some implementations, each wave spring cooperates with a fastener 202 (such as a threaded pin), whereby the fastener 202 is disposed in the center space 402. In such an arrangement, the wave spring may have one end in contact with the shaft 104 and another end in contact with pad 116. Hence, the wave spring may apply a radial force from the shaft 104 to the pad 116 to maintain contact between the pad 116 and the housing 102. Some implementations may utilize other spring types and/or components to apply the forces noted herein such as compression springs, belleville washers, wave washers, torsion springs, and/or any other suitable components. The amount of needed radial force may vary. For example, with a heavier shaft 104 for which more frictional force is needed for reducing spin rate, the spring 302 may be larger, heavier, or otherwise configured to apply more radial force. For lighter shafts, lighter or smaller springs may be used to achieve desired spin rates. Hence, the springs may have a spring rate suitable to achieve the desired performance of the tool.

Figure 4B:
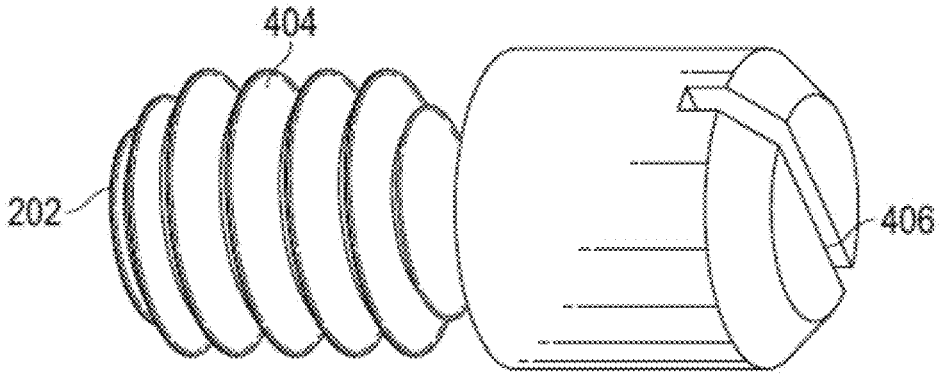
FIG. 4B is a perspective view of a fastener that may be included in a brake of the tool.

FIG. 4B is a perspective view of a fastener that may be included in a brake of the tool. In FIG. 4B, the faster 202 is a threaded pin. The faster 202 may include threads 404 and a slotted end 406. The threaded pin may be threaded into the shaft 104 and may be coupled with a pad 116 to hold the pad 116 within a range of motion. Some implementations may utilize any other suitable fasteners to keep the spring 302 in place.

Figure 5:
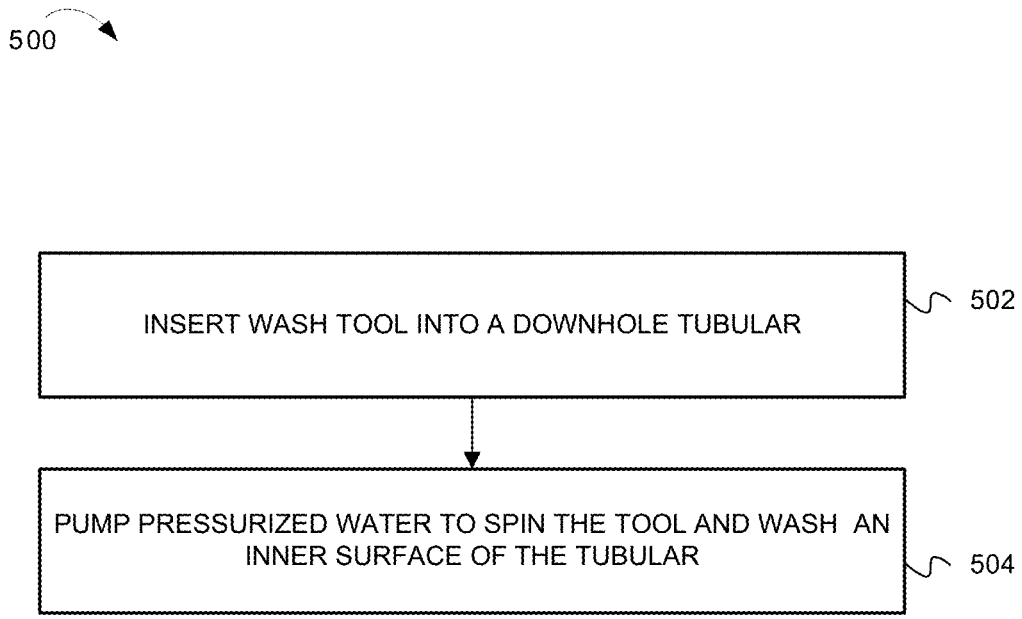
FIG. 5 is a flow diagram illustrating operations for using a washing tool to wash a downhole tubular.

FIG. 5 is a flow diagram illustrating operations for using a washing tool to wash a downhole tubular. In the flow diagram 500, operations begin at block 502. At block 502, the washing tool 100 may be inserted into a downhole tubular (such as a tubular residing in a wellbore). Flow continues at block 504. At block 504, pressurized fluid is pumped into the washing tool 100 to spin the washing tool and wash an inner surface of the tubular.

Figure 6:
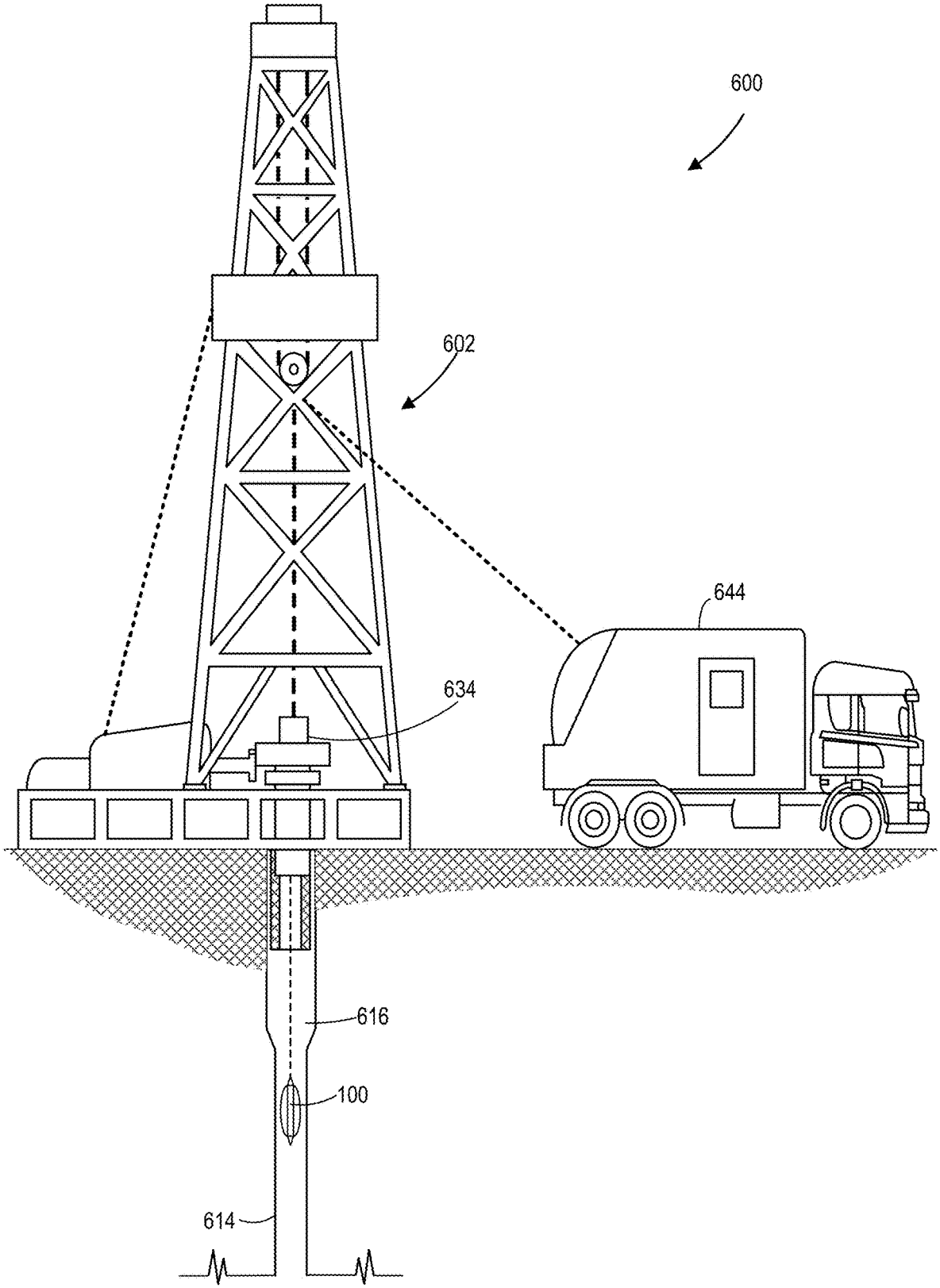
FIG. 6 is a perspective view of an example positioning system that may be used with the washing tool.

FIG. 6 is a perspective view of an example positioning system that may be used with the washing tool. Subterranean operations may be conducted using the positioning system 600 after a drillstring has been removed, though, at times, some or all of the drill string may remain in a borehole 614 during washing operations with the washing tool 100. The positioning system 600 may include one or more washing tools 100 that may be suspended in the borehole 614 by a conveyance 616 (such as coiled tubing, a wireline, etc.). A truck 644 may control the conveyance 616. In some implementations, the derrick 602 is not on the wellsite. The washing tool 100 may be fluidically coupled to a source of pressurized fluid (such as water). The washing tool 100 also may be electrically and communicatively coupled to power sources and communications networks. The positioning system 600 may contain a control unit 634 that contains memory, one or more batteries, and/or one or more processors for performing operations with the washing tool 102.

In certain implementations, the control unit 634 may be located at the surface, in the borehole (e.g., in the washing tool 100) or both (e.g., a portion of the processing may occur downhole and a portion may occur at the surface). The control unit 634 may include a control system or a control algorithm. In certain embodiments, a control system, an algorithm, or a set of machine-readable instructions may cause the control unit 634 to control the washing tool 100 in operations for washing downhole tubulars. The computing facilities may be communicatively coupled to the washing tool 100 and may operate similarly to the control unit 634. In certain example embodiments, the control unit 634, which may be located in the washing tool 100, may perform one or more functions of the computing facility.

During operation, the washing tool 100 may receive pressurized fluid that causes a cleaning head of the washing tool to spin (as described herein) and wash material from an inner surface of downhole tubulars. Brakes 114 of the washing tool 100 may control the spin rate of the washing tool 100. In some implementations, the brakes 114 utilize centrifugal forces from a spinning shaft to create frictional forces that control the spin rate. As the shaft spins at a higher rate, the centrifugal forces enable the brakes to apply greater frictional forces that control the shaft's spin rate-thus controlling the spin rate of the tool's washing head.

As will be appreciated, aspects of the disclosure may be embodied as a system, method or program code/instructions stored in one or more tangible machine-readable media. Accordingly, aspects may take the form of hardware, software (including firmware, resident software, micro-code, etc.), or a combination of software and hardware aspects that may all be referred to herein as a "circuit," "module" or "system." The functionality presented as individual components in the example illustrations may be organized differently.

As used herein, the term "or" is inclusive unless otherwise explicitly noted. Thus, the phrase "at least one of A, B, or C" is satisfied by any element from the set {A, B, C} or any combination thereof, including multiples of any element.

Some implementations may aspects as described in the following clauses.

Clause 1: An apparatus for washing a downhole tubular, the apparatus comprising: a head coupled to a rotatable shaft, the head including one or more jets configured to emit fluid to cause the head to rotate on the rotatable shaft and wash the downhole tubular; and one or more brakes coupled with the rotatable shaft and configured to control rotation of the head.

Clause 2: The apparatus of clause 1, wherein at least one of the jets is positioned to emit the fluid in an eccentric direction from the head to produce thrust to cause the head to rotate on the rotatable shaft, and wherein at least one of the jets is positioned to emit the fluid in a radial to wash the downhole tubular Clause 3: The apparatus of any one or more of clauses 1-2, wherein the brakes include: one or more pads; one or more springs coupled with the shaft and the pads, each spring configured to maintain a respective pad in contact with a housing of the apparatus; and one or more pins configured to couple each of the springs to the rotatable shaft.

Clause 4: The apparatus of any one or more of clauses 1-3, wherein the pads include elastomeric material configured to contact the housing, and wherein the springs are wave springs.

Clause 5: The apparatus of any one or more of clauses 1-4, wherein the rotatable shaft includes a cavity configured to convey the fluid to the jets Clause 6: The apparatus of any one or more of clauses 1-5, wherein the apparatus includes a housing including a thread configured to connect the apparatus to coiled tubing.

Clause 7: The apparatus of any one or more of clauses 1-6, wherein the head includes a threaded coupling configured to thread onto a threaded connection that is connected to the shaft.

Clause 8: A system for washing a downhole tubular, the system comprising: coiled tubing configured to be lowered into the downhole tubular; one or more pumps to pump pressurized fluid through the coiled tubing; a washing tool coupled with the coiled tubing, the washing tool including head coupled to a rotatable shaft, the head including one or more jets configured to direct pressurized fluid to cause the head to rotate on the rotatable shaft and wash the downhole tubular, one or more brakes coupled with the rotatable shaft and configured to control rotation of the head.

Clause 9: The system of clause 8, wherein at least one of the jets is positioned to emit the fluid in an eccentric direction from the head to produce thrust to cause the head to rotate on the rotatable shaft, and wherein at least one of the jets is positioned to emit the fluid in a radial direction to wash the downhole tubular.

Clause 10: The system of any one or more of clauses 8-9, wherein the brakes include one or more pads; one or more springs coupled the shaft and the pads, each spring configured to hold a respective pad in contact with a housing of the washing tool; and one or more pins configured to connect each of the springs with the rotatable shaft.

Clause 11: The system of any one or more of clauses 8-10, wherein the pads include elastomeric material configured to contact the housing, and wherein the springs are wave springs.

Clause 12: The system of any one or more of clauses 8-11, wherein the rotatable shaft includes a cavity configured to convey the fluid to the jets.

Clause 13: The system of any one or more of clauses 8-12, wherein the washing tool includes a housing including a thread configured to connect the washing tool to the coiled tubing.

Clause 14: The system of any one or more of clauses 8-13, wherein the head includes a threaded coupling configured to thread onto a threaded connection that is connected to the shaft.

Clause 15: A method for washing a tubular disposed in a wellbore, the method comprising: inserting a tool into the tubular disposed in the wellbore, the tool including a head coupled to a rotatable shaft, the head including one or more jets configured to emit fluid to cause the head to rotate on the rotatable shaft and wash the tubular, and one or more brakes coupled with the rotatable shaft and configured to contact the housing to control rotation of the head; and pumping pressurized fluid to the tool to spin the head and wash an inner surface of the tubular.

Clause 16: The method of clause 15, wherein the jets are positioned to emit the fluid in an eccentric direction from the head to produce thrust to cause the head to rotate on the rotatable shaft.

Clause 17: The method of any one or more of clauses 15-16, wherein the brakes include: one or more pads; one or more springs coupled the shaft and the pads, each spring configured to maintain a respective pad in contact with the housing; and one or more pins configured to connect each of the springs with the rotatable shaft.

Clause 18: The method of any one or more of clauses 15-17, wherein the pads include elastomeric material configured to contact the housing, and wherein the springs are wave springs.

Clause 19: The method of any one or more of clauses 15-18, wherein the rotatable shaft includes a cavity configured to convey the fluid to the jets.

Clause 20: The method of any one or more of clauses 15-19, wherein an end of the housing includes a thread configured to connect the tool to coiled tubing.

What is claimed is:

1. An apparatus for washing a downhole tubular, the apparatus comprising:

a head coupled to a rotatable shaft, the head including a plurality of jets configured to emit fluid to wash the downhole tubular, wherein one or more jets of the plurality of jets are oriented to cause the head to rotate on the rotatable shaft; and one or more brakes coupled with the rotatable shaft and configured to control rotation of the head, wherein the one or more brakes include:

one or more pads, and one or more springs coupled with the rotatable shaft and the pads, each spring configured to maintain a respective pad in contact with a housing of the apparatus.

2. The apparatus of claim 1, wherein at least one of the one or more jets is positioned to emit the fluid in an eccentric direction from the head to produce thrust to cause the head to rotate on the rotatable shaft, and wherein at least one of the plurality of jets is positioned to emit the fluid in a radial direction to wash the downhole tubular.

3. The apparatus of claim 1, wherein the one or more brakes include:

one or more pins configured to couple each of the springs to the rotatable shaft.

4. The apparatus of claim 1, wherein the pads include elastomeric material configured to contact the housing, and wherein the springs are wave springs.

5. The apparatus of claim 1, wherein the rotatable shaft includes a cavity configured to convey the fluid to the plurality of jets.

6. The apparatus of claim 1, wherein the housing includes a thread configured to connect the apparatus to coiled tubing.

7. The apparatus of claim 1, wherein the head includes a threaded coupling configured to thread onto a threaded connection that is connected to the rotatable shaft.

8. A system for washing a downhole tubular, the system comprising:

coiled tubing configured to convey pressurized fluid; and a washing tool coupled with the coiled tubing, the washing tool including a head coupled to a rotatable shaft, the head including a plurality of jets configured to emit the pressurized fluid to wash the downhole tubular, wherein one or more jets of the plurality of jets are oriented to cause the head to rotate on the rotatable shaft, and one or more brakes coupled with the rotatable shaft and configured to control rotation of the head, wherein the one or more brakes include:

one or more pads, and one or more springs coupled with the rotatable shaft and the pads, each spring configured to maintain a respective pad in contact with a housing of the washing tool.

9. The system of claim 8, wherein at least one of the one or more jets is positioned to emit the pressurized fluid in an eccentric direction from the head to produce thrust to cause the head to rotate on the rotatable shaft, and wherein at least one of the plurality of jets is positioned to emit the pressurized fluid in a radial direction to wash the downhole tubular.

10. The system of claim 8, wherein the one or more brakes include:

one or more pins configured to connect each of the springs with the rotatable shaft.

11. The system of claim 8, wherein the pads include elastomeric material configured to contact the housing, and wherein the springs are wave springs.

12. The system of claim 8, wherein the rotatable shaft includes a cavity configured to convey the pressurized fluid to the plurality of jets.

13. The system of claim 8, wherein the housing includes a thread configured to connect the washing tool to the coiled tubing.

14. The system of claim 8, wherein the head includes a threaded coupling configured to thread onto a threaded connection that is connected to the rotatable shaft.

15. A method for washing a tubular disposed in a wellbore, the method comprising:

inserting a tool into the tubular disposed in the wellbore, the tool including a head coupled to a rotatable shaft, the head including a plurality of jets configured to emit fluid to cause the head to wash the tubular, wherein one or more jets of the plurality of jets are oriented to cause the head to rotate on the rotatable shaft, and one or more brakes coupled with the rotatable shaft and configured to control rotation of the head wherein the one or more brakes include:

one or more pads, and one or more springs coupled with the rotatable shaft and the pads, each spring configured to maintain a respective pad in contact with a housing of the tool; and pumping pressurized fluid to the tool to spin the head and wash an inner surface of the tubular.

16. The method of claim 15, wherein the one or more jets are positioned to emit the fluid in an eccentric direction from the head to produce thrust to cause the head to rotate on the rotatable shaft.

17. The method of claim 15, wherein the one or more brakes include:

one or more pins configured to connect each of the springs with the rotatable shaft.

18. The method of claim 15, wherein the pads include elastomeric material configured to contact the housing of the tool, and wherein the springs are wave springs.

19. The method of claim 15, wherein an end of the housing includes a thread configured to connect the tool to coiled tubing.

20. The method of claim 15, wherein the rotatable shaft includes a cavity configured to convey the fluid to the plurality of jets.

* * * * *